US007701105B2

(12) United States Patent
Bailey

(10) Patent No.: US 7,701,105 B2
(45) **Date of Patent: *Apr. 20, 2010**

(54) CRYOGENIC PUMPING SYSTEMS, ROTORS, AND METHODS FOR PUMPING CRYOGENIC FLUIDS

(75) Inventor: Michael R. Bailey, Mena, AR (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/390,968

(22) Filed: Feb. 23, 2009

(65) Prior Publication Data

US 2009/0179516 A1 Jul. 16, 2009

Related U.S. Application Data

(63) Continuation of application No. 11/023,760, filed on Dec. 22, 2004, now Pat. No. 7,495,364.

(60) Provisional application No. 60/633,343, filed on Dec. 3, 2004.

(51) Int. Cl.
*H02K 17/16* (2006.01)

(52) U.S. Cl. ..... 310/211

(58) Field of Classification Search ..... 310/201, 310/211, 212, 261

See application file for complete search history.

(56) References Cited

U.S. PATENT DOCUMENTS

| | | | | |
|---|---|---|---|---|
| 1,695,799 | A | 12/1928 | Daun | |
| 1,936,244 | A | 11/1933 | Bergstrom | |
| 3,134,040 | A | 5/1964 | Barth | |
| 3,194,996 | A * | 7/1965 | Lynn | 310/211 |
| 3,662,195 | A | 5/1972 | Wielt | |
| 3,826,940 | A | 7/1974 | McKean et al. | |
| 4,593,835 | A | 6/1986 | Kikkawa et al. | |
| 4,761,602 | A | 8/1988 | Leibovich | |
| 5,990,595 | A | 11/1999 | Crowell | |

(Continued)

FOREIGN PATENT DOCUMENTS

| | | |
|---|---|---|
| JP | 55125065 | 9/1980 |

(Continued)

OTHER PUBLICATIONS

Machine translation of JP 2003-274,621, Endo et al. "Rotor of induction motor, connects conductor bar and end ring by friction stirring welding", Sep. 26, 2003.*

(Continued)

*Primary Examiner*—Karl I Tamai
(74) *Attorney, Agent, or Firm*—Harness, Dickey & Pierce, P.L.C.

(57) ABSTRACT

A cryogenic pumping system for pumping a cryogenic fluid generally includes a rotor having a plurality of slots. The rotor includes at least one endring defining a plurality of openings. Each opening is aligned with a different one of the slots. A plurality of rotor bars are each positioned within a different one of the slots. Each rotor bar includes an end portion received within a different one of the openings and welded to the endring. The cryogenic pumping system can be used to pump a cryogenic fluid from a first location to a second location.

22 Claims, 7 Drawing Sheets

U.S. PATENT DOCUMENTS

| | | | | |
|---|---|---|---|---|
| 6,213,736 | B1 | 4/2001 | Weisser | |
| 6,867,527 | B2 * | 3/2005 | Moore | 310/211 |
| 7,495,364 | B2 * | 2/2009 | Bailey | 310/211 |
| 2003/0218400 | A1 | 11/2003 | Rimmel | |
| 2004/0113508 | A1 * | 6/2004 | Yasuhara et al. | 310/211 |
| 2006/0119194 | A1 * | 6/2006 | Bailey | 310/61 |

FOREIGN PATENT DOCUMENTS

| | | | |
|---|---|---|---|
| JP | 04-058748 | | 2/1992 |
| JP | 2003-274621 | * | 9/2003 |

OTHER PUBLICATIONS

Manual translation of JP 04-058748, Kawabata et al., "Rotor for induction motors", Feb. 25, 1992.*

Armor Line® Series 7000, 2 pages.

R. L. Nailen, Louis Allis, Milwaukee, Wisconsin, Oct. 18, 1972, 22 pages.

R. L. Nailen, Louis Allis, Milwaukee, Wisconsin, Sep. 25, 1972, 5 pages.

Developpements recents dans la technsique des cages rotoriques des moteurs asynchrones, Revue Generale De L'Electricite, J. Bichet, Sep. 1966, 22 pages.

Comportement en regime transitoire des cages de moteurs asynchrones, Revue Generale De L'electricite, Revue Generale De L'Electricite, R. Blanchardie, et al, Sep. 1966, 39 pages.

L'experimentation entreprise au Banc d'Essai l'Electricite de France dans le domaine des rotors a cage, Revue Generale de L'Electricite, G. Leroy, et al, Sep. 1966, 43 pages.

Conditions d'emploi des moteurs asynchrones haute tension dans les centrales thermiques d'Electricite de France, Revue Generale De L'Electricite, Y. Enault, Sep. 1966, 20 pages.

Definition due fonctionnement des machines asynchrones de grande puissance, R. Blanchardie, 50 pages.

Elliott's Answer to Rotor Bar Breakage, Powerfax, Winter 1960, pp. 10-13.

"Some commentary on the choice of rotor bar material for induction motors", Dymond et al., Sep. 3, 1995; IEEE transactions on Energy Conversion, vol. 10, No. 3.

* cited by examiner

CRYOGENIC PUMPING SYSTEMS, ROTORS, AND METHODS FOR PUMPING CRYOGENIC FLUIDS

CROSS-REFERENCE TO RELATED APPLICATIONS

This application is a continuation of U.S. patent application Ser. No. 11/023,760 filed Dec. 22, 2004. This application claims the benefit of U.S. Provisional Application No. 60/633,343 filed Dec. 3, 2004. The entire disclosures of the above applications are incorporated herein by reference.

FIELD

The present disclosure generally relates to cryogenic pumping systems, methods for pumping cryogenic fluids, and rotors suited for use in cryogenic pumps.

BACKGROUND

This section provides background information related to the present disclosure which is not necessarily prior art.

Fabricated rotor cores typically include three primary components, namely, a stack of laminations, rotor bars positioned within slots defined by the laminations, and two endrings positioned on opposite sides of the stack of laminations. Traditionally, the endrings have been formed by casting. To cast one of the endrings, a mold is positioned on top of the stack of laminations over ends of the rotor bars. Molten material is poured into the mold, and allowed to cool to form the endring. In order to mechanically bond and electrically connect the rotor bars to the endring, the endring is cast at a temperature sufficient to melt the ends of the rotor bars.

SUMMARY

This section provides a general summary of the disclosure, and is not a comprehensive disclosure of its full scope or all of its features.

According to one aspect of the present disclosure, a rotor has a plurality of slots and includes at least one endring defining a plurality of openings, each opening aligned with a different one of the slots, a plurality of rotor bars each positioned within a different one of the slots, each rotor bar including an end portion received within a different one of the openings, and each slot including a relief portion only on an interior side of the slot for allowing the rotor bar within the slot to deflect generally radially inward into the relief portion.

According to another aspect of the present disclosure, a rotor has a plurality of slots and includes at least one endring defining a plurality of openings, each opening aligned with a different one of the slots, a plurality of rotor bars each positioned within a different one of the slots, each rotor bar including an end portion received within a different one of the openings, and each slot including a relief portion for allowing the rotor bar within the slot to freely deflect into the relief portion.

According to yet another aspect of the present disclosure, a rotor has a plurality of slots and includes at least one endring defining a plurality of openings, each opening aligned with a different one of the slots, a plurality of rotor bars each positioned within a different one of the slots, each rotor bar including an end portion received within a different one of the openings, the endring mechanically attached to the rotor without fasteners, and each slot including a relief portion for allowing the rotor bar within the slot to deflect into the relief portion.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding features throughout the several views of the drawings.

DETAILED DESCRIPTION OF EXEMPLARY EMBODIMENTS

Example embodiments will now be described more fully with reference to the accompanying drawings.

Figure 1:
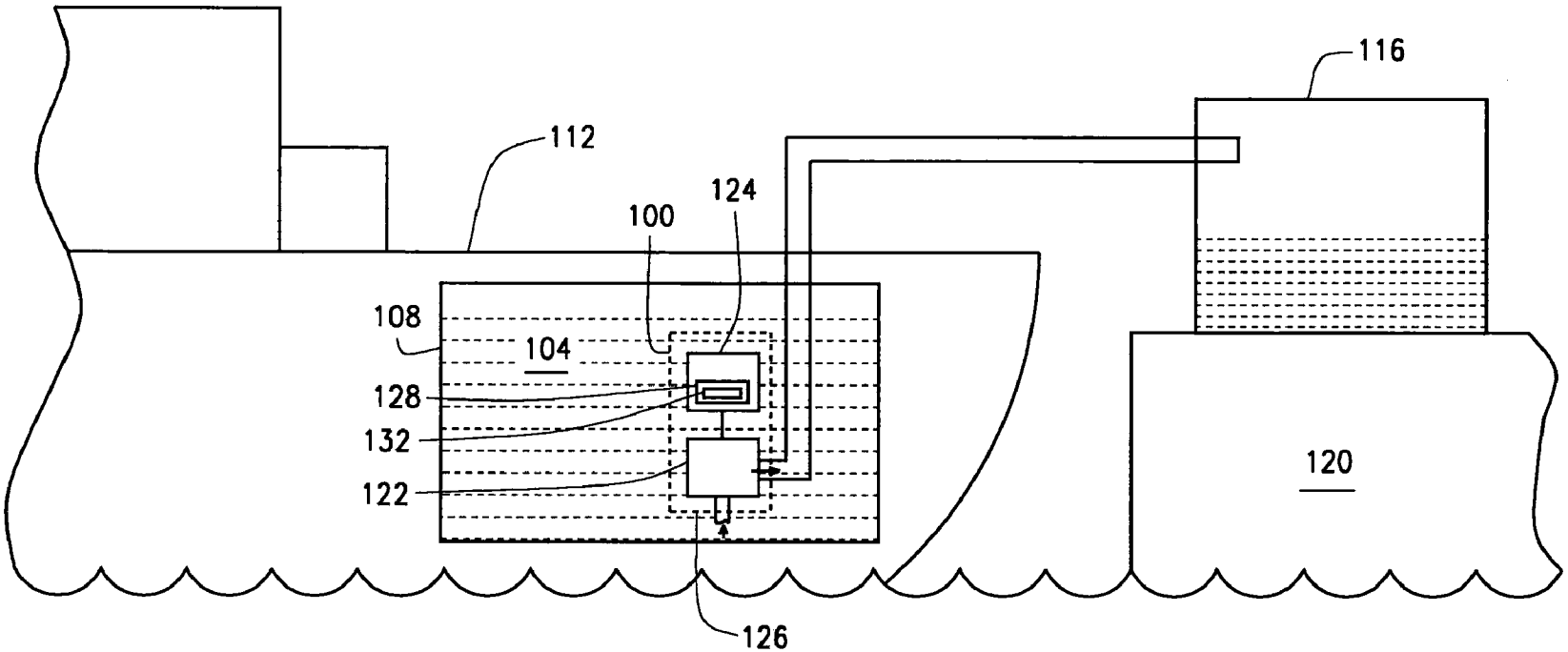
FIG. 1 is a block diagram representation of a cryogenic pumping system used to pump a cryogenic fluid according to one exemplary embodiment of the present disclosure.

A method according to one aspect of the present disclosure generally includes pumping a cryogenic fluid from a first location to a second location. By way of example only, FIG. 1 illustrates a cryogenic pumping system or assembly 100 being used to pump liquefied natural gas 104 from a storage vessel 108 onboard a tanker ship 112 to an onshore storage vessel 116 located at a sea port 120. As shown in FIG. 1, the cryogenic pumping system 100 includes a pump 122 and an electric motor 124 that generates the mechanical power for operating the pump 122. In the illustrated embodiment, the pump 122 and electric motor 124 are positioned within housing 126 of the cryogenic pumping system 100, although this is not required. Also shown in FIG. 1, the electric motor 124 includes a rotor 128, which, in turn, includes a rotor core 132.

Figure 2:
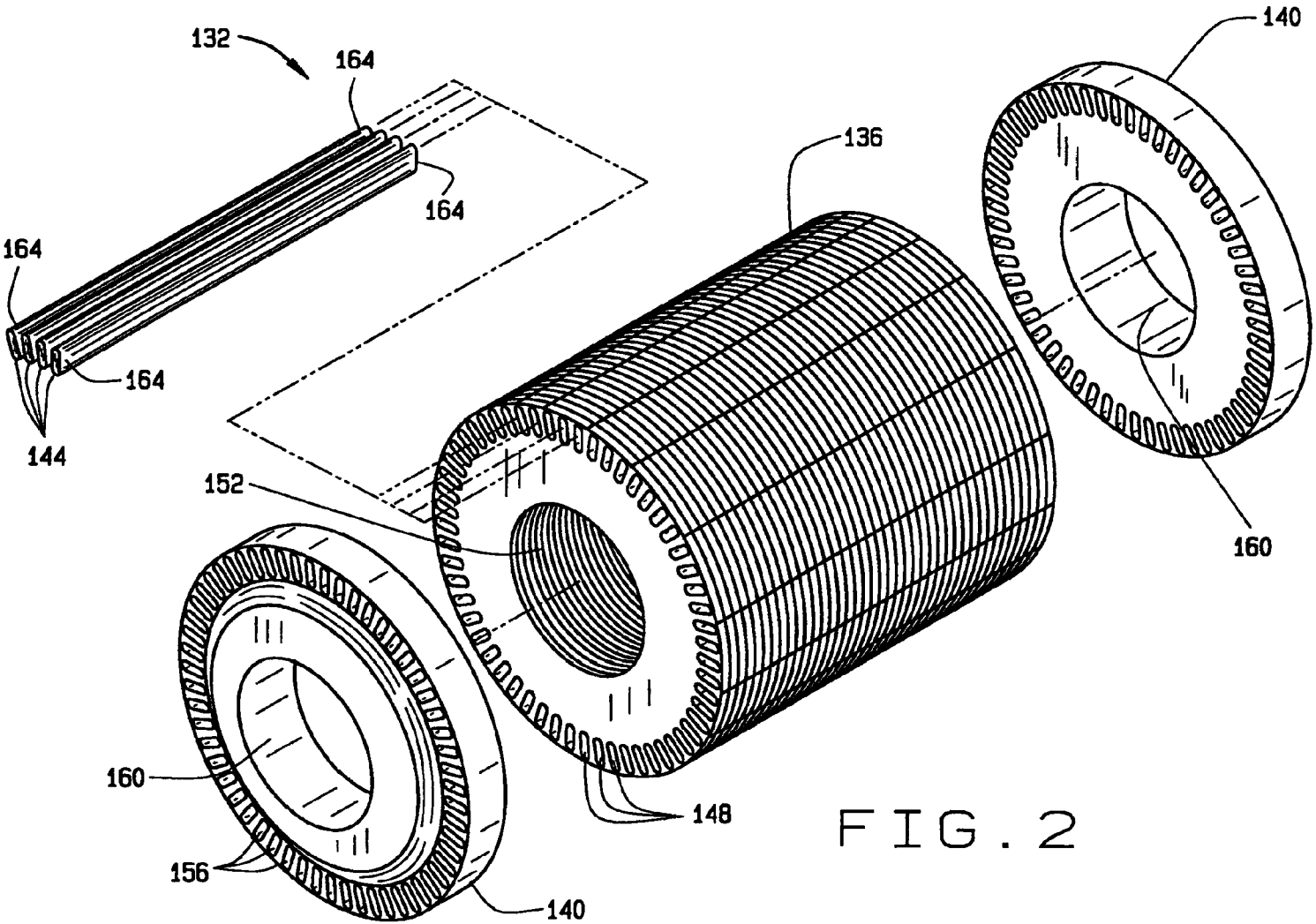
FIG. 2 is an exploded perspective view of a rotor core according to one exemplary embodiment of the present disclosure.

An exemplary embodiment of a rotor core suitable for use in rotor 128, cryogenic pumping system 100 and/or cryogenic environment is shown in the figures. As shown in FIG. 2, a rotor core 132 includes a stack of laminations 136, a pair of endrings 140 positioned on opposite sides of the lamination stack 136, and a plurality of rotor bars 144.

The laminations 136 define a plurality of slots 148 each sized to receive one of the rotor bars 144 therein. The laminations 136 also define a generally central opening 152 sized to receive a shaft (not shown) to which the rotor core 132 can ultimately be coupled for common rotation therewith.

Each endring 140 defines a plurality of openings 156. Each opening 156 is aligned with a different one of the slots 148. Each endring 140 also defines a generally central opening 160 sized to receive the shaft to which the rotor core 132 can ultimately be coupled.

Figure 3:
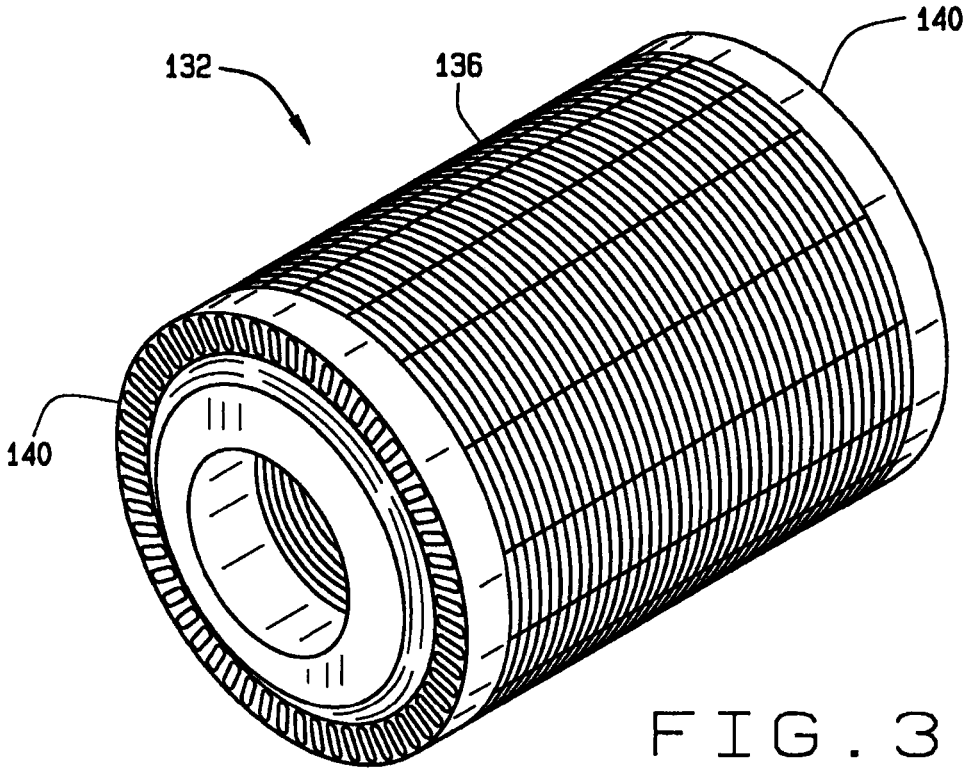
FIG. 3 is a perspective view of the rotor core shown in FIG. 2 after it has been assembled but before the endrings have been welded to the rotor bars.

Each rotor bar 144 is positioned within a different one of the slots 148. As shown in FIG. 3, each rotor bar 144 includes an end portion 164 received within a different one of the openings 156 and welded to the endring 140, as described in detail below.

In the illustrated embodiment of FIGS. 2 through 10, the rotor bars 144 each have a generally oval-shaped cross section. The lamination slots 148 and the endring openings 156 also have generally oval-shaped cross sections. Alternatively, other shapes can be used for the rotor bars, the lamination slots, and/or the openings in the endrings. Further, the number, size, and shape of the rotor bars 144, lamination slots 148, and/or endring openings 156 can vary depending, for example, on the particular application in which the rotor core 132 will be used.

Various processes can be used to form the endrings 140 and/or other rotor components. In one exemplary embodiment, the endrings 140 are formed by machining. This can be advantageous in that machining generally allows a higher yield strength material to be used as compared to casting and forging processes. For example, one particular embodiment includes machining the endrings 140 entirely from 6061 T-6 aluminum alloy, which has a higher yield strength than pure aluminum (a material commonly used for casting endrings).

In some embodiments, only the end portions 164 of the rotor bars 144 are welded to the endring 140, and the endrings 140 are not bonded directly to the laminations 136. In these embodiments, the endrings 140 are able to slide or move relatively freely in the radial direction relative to the laminations 136. This can be advantageous in cryogenic applications where the cryogenic temperatures can cause significant differential thermal contraction between the endrings 140 and the laminations 136. For such embodiments, machining is typically better than casting for forming the endrings. This is because casting processes are typically performed at such a high temperature that portions of the endring and/or laminations melt. In which case, upon cooling the endring is bonded directly to the laminations. With machining, however, the endrings can be formed at lower temperatures such that in some embodiments the endrings 140 are not directly bonded to the laminations 136 themselves.

Further, forming the endrings at the lower temperatures associated with machining can also allow improvements in the straightness of the rotor core as compared to rotors cores in which the endrings are formed by forging or casting. The relatively high temperatures associated with such forging or casting processes can cause at least some movement and/or distortion of the rotor core components.

A wide range of materials can be used for the various components of the rotor core. In some embodiments, the endrings 140 and rotor bars 144 are formed entirely from the same material(s). In a particular embodiment, the endrings 140 and rotor bars 144 are formed entirely from 6061 T-6 aluminum alloy.

Figure 4:
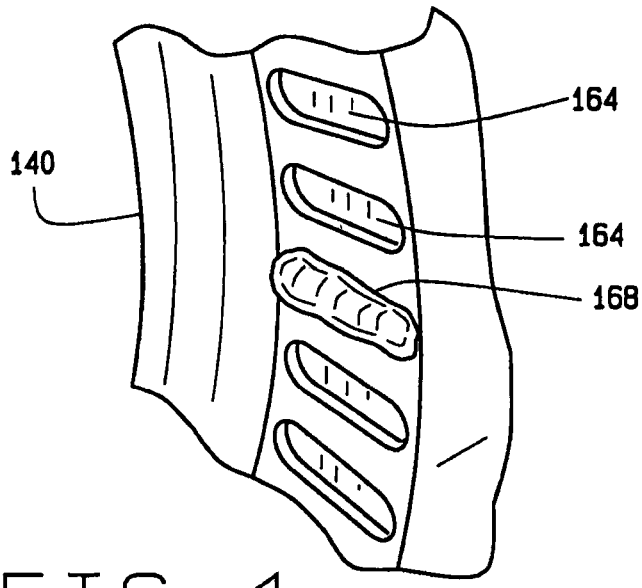
FIG. 4 is a partial view of an endring shown in FIG. 3 and further illustrating a weld between the endring and an end portion of a rotor bar.
Figure 5A:
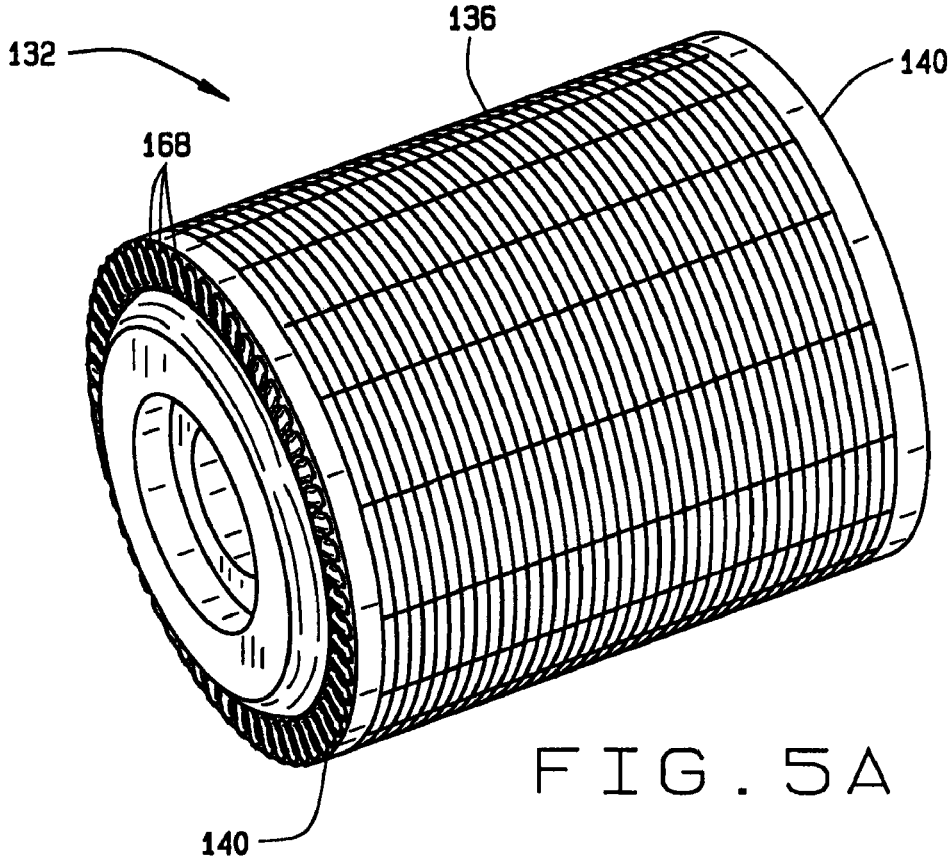
FIGS. 5A and 5B are perspective views of the rotor core shown in FIG. 3 and illustrating one of the endrings welded to end portions of the rotor bars.
Figure 5B:
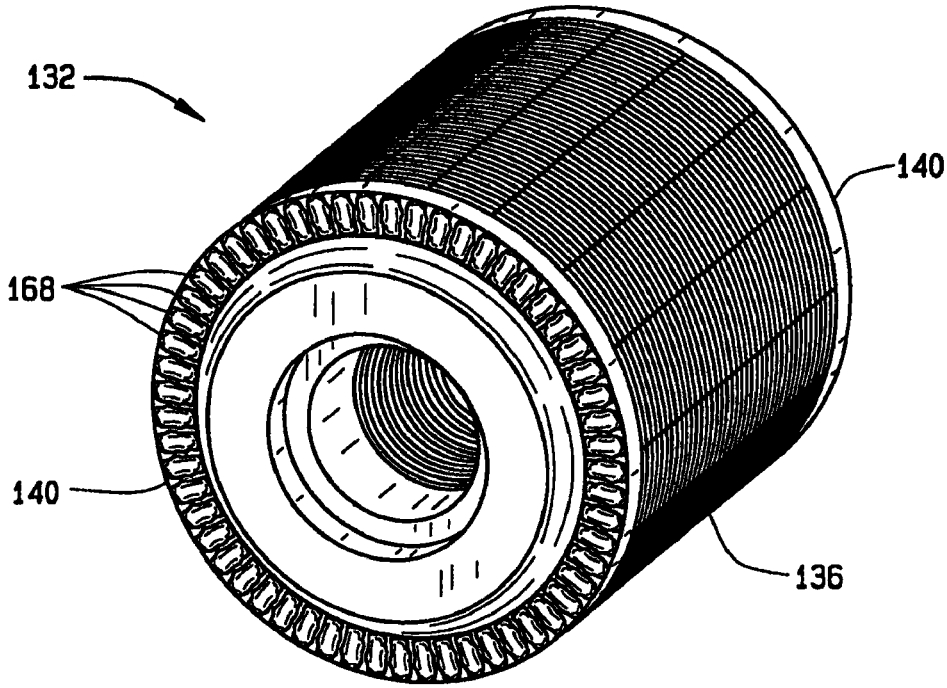
Figure 7:
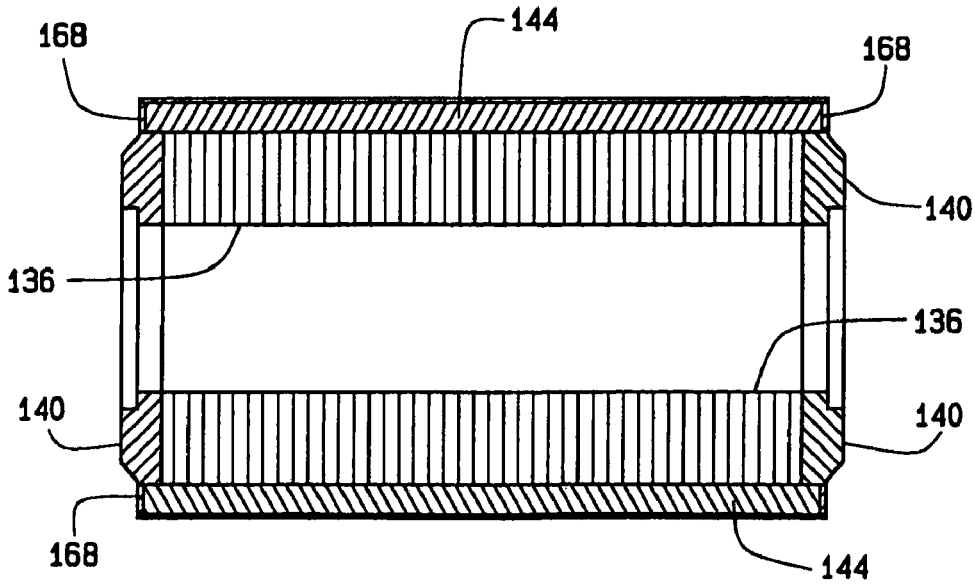
FIG. 7 is a longitudinal cross-sectional view of the rotor core shown in FIG. 6.
Figure 8:
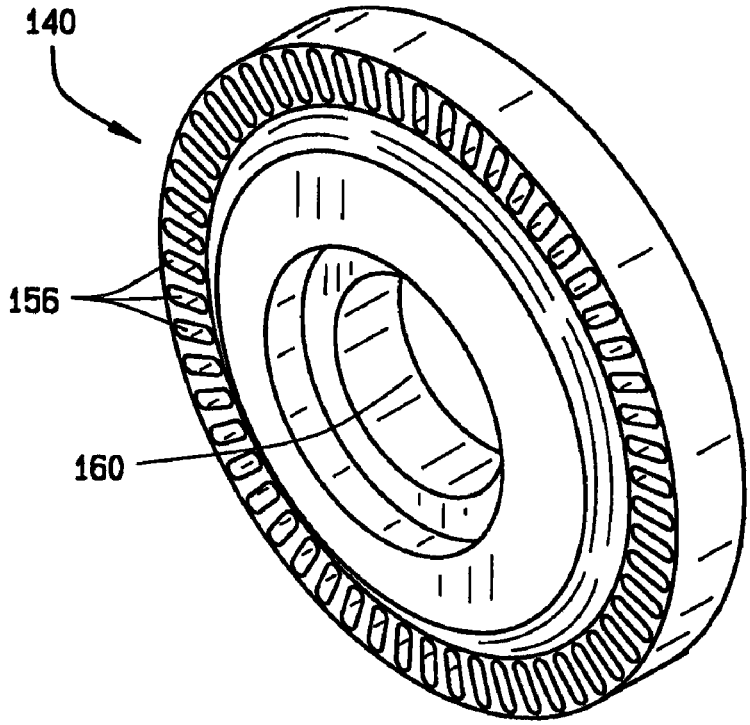
FIG. 8 is a perspective view of an endring according to an exemplary embodiment of the present disclosure.
Figure 9:
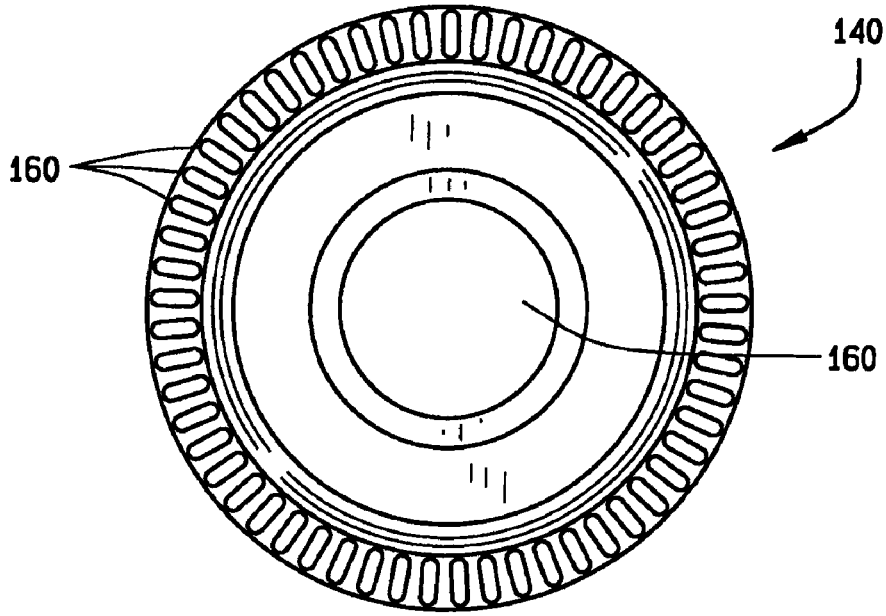
FIG. 9 is an upper plan view of the endring shown in FIG. 8.

In some embodiments, only the end portions 164 of the rotor bars 144 are welded to the endrings 140, as shown in FIGS. 4, 5, and 7. In such embodiments, the welds 168 between each endring 140 and the rotor bar end portions 164 are a spaced distance from the laminations 136. Further, the endrings 140 are not directly bonded by welding or otherwise to the laminations 136 themselves. In these embodiments, the endrings 140 are thus able to slide or move relatively freely in the radial direction relative to the laminations 136. This feature can help eliminate or at least inhibit the stress riser and stress concentration that can typically occur at the lamination-to-endring interface or joint with traditional rotor core constructions.

In addition, welding the rotor bars 144 to the endrings 140 can also create higher strength joints than that produced with traditional rotor core constructions.

A wide range of materials can be used to form the welds between the endring 140 and the rotor bars 144. In various embodiments, the weld or fill material has properties similar to the properties of the material(s) forming the endring and/or rotor bars are formed.

In one embodiment, a 5356 aluminum alloy electrode is used to form the welds between the endrings 140 and the rotor bar end portions 164. This can be beneficial when the endring 140 and rotor bars 144 are formed entirely from 6061 T-6 aluminum alloy because the weld wire of the 5356 aluminum alloy electrode has substantially similar material properties to the 6061 T-6 aluminum alloy. Alternatively, other materials can be used for the welding wire, filler metals, rotor bars, and/or endring.

Figure 6:
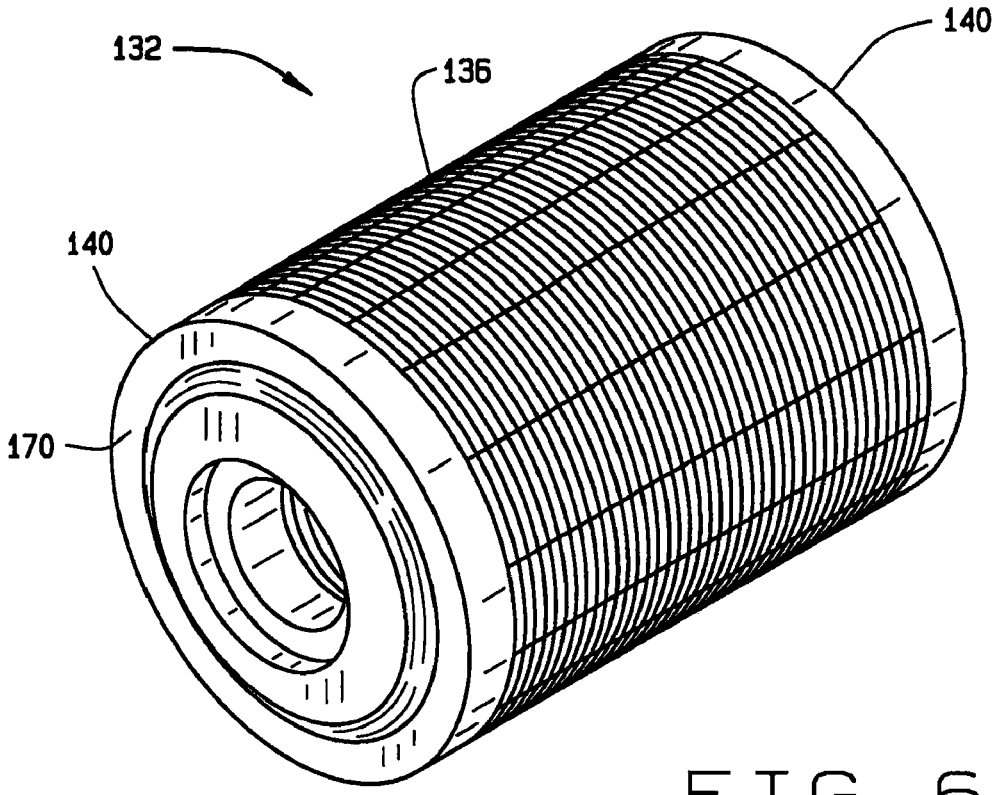
FIG. 6 is a perspective view of the rotor core shown in FIGS. 5A and 5B after machining has been performed in order to provide an attractively smooth surface finish.

After each rotor bar end portion 164 has been welded to the endrings 140, some embodiments can also include capping the weld area on each endring 140 with a cap weld, and then machining to cleanup the cap weld. This machining can provide a substantially smooth surface 170 having a high or production-wise quality surface finish that is cosmetically pleasing to the user, as shown in FIG. 6.

Figure 10:
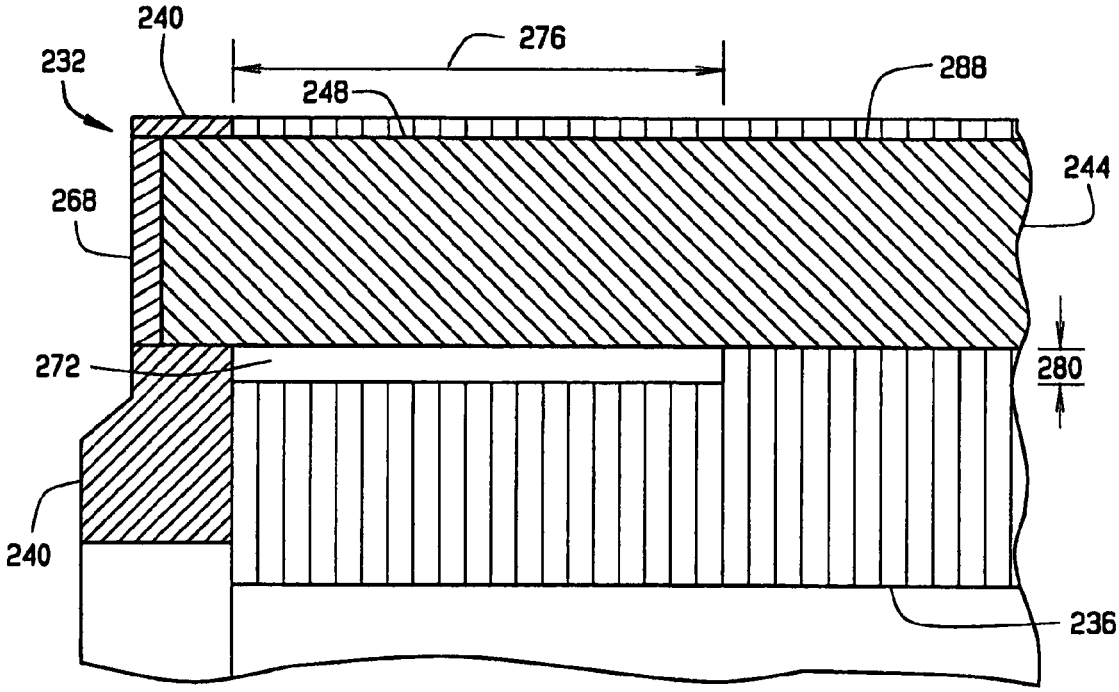
FIG. 10 is a partial longitudinal cross-sectional view of a rotor core according to another exemplary embodiment and illustrating a relief portion positioned on an interior side of a slot that allows the rotor bar within that slot to deflect into the relief portion.
Figure 11:
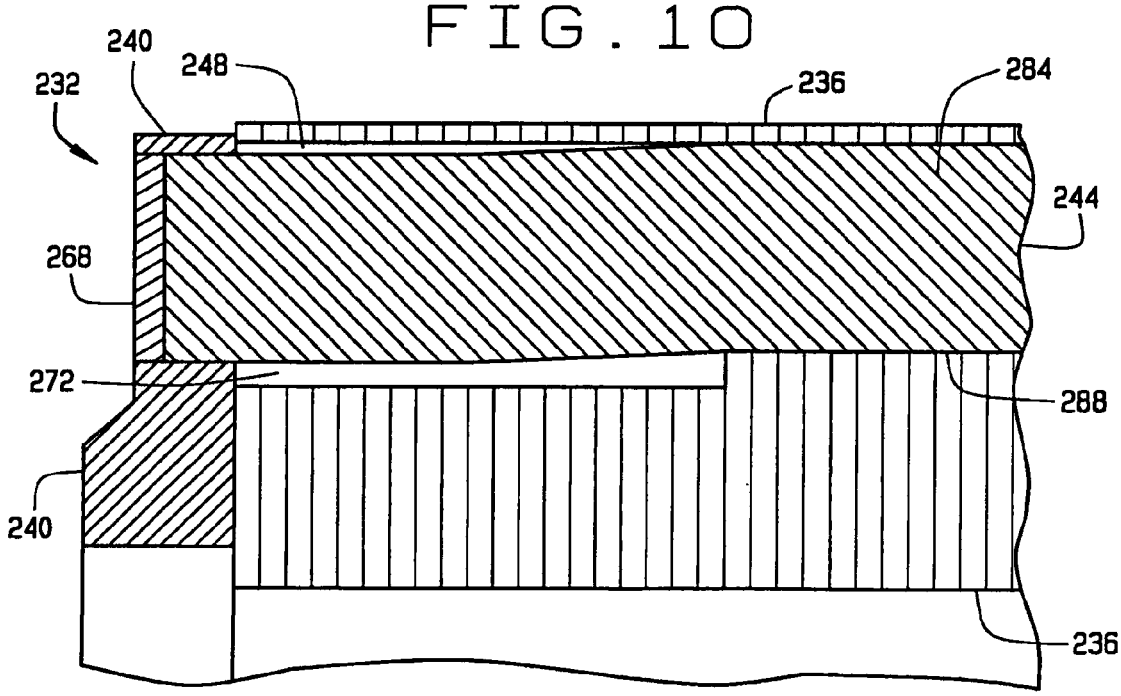
FIG. 11 is a partial longitudinal cross-sectional view of the rotor core shown in FIG. 10 and illustrating the rotor bar deflected generally radially inward into the relief portion.

In some embodiments, each slot includes a relief portion or clearance to allow the rotor bar within that slot to deflect into the relief portion. As shown in FIGS. 10 and 11, a relief portion 272 is positioned on an interior side of the slot 248 to allow the rotor bar 244 within that slot 248 to deflect generally radially inward into the relief portion 272 (as shown in FIG. 11). In this particular embodiment, FIG. 10 depicts the rotor core 232 at an ambient room temperature, and FIG. 11 depicts the rotor core 232 at a cryogenic temperature. FIGS. 10 and 11 also depict the weld 268 between the rotor bar 244 and the endring 240.

During operation, the rotor core 232 can be disposed within (e.g., submerged, etc.) a cryogenic fluid. Due to the extremely cold or cryogenic temperatures, the endrings 240 may contract in the radial direction to a greater extent than that of the laminations 236. The relief portions 272 allow the rotor bars 244 to deflect or flex radially inward as the endring 240 contracts. This, in turn, can significantly reduce stress concentrations and shearing forces (and possible crack formation and propagation caused thereby) between the endring 240 and rotor bars 244.

By increasing the size of the openings into which the rotor bars 244 are inserted, the relief portions 272 can also facilitate insertion of the rotor bars 244 into the slots 248. In one embodiment, each relief portion 272 has an axial length 276 of about four inches, and a radial thickness or width 280 of about 0.03 inches. In comparison, the entire axial length of the slot 248 (which corresponds to the axial length of the lamination stack 236) can be about thirty-six inches. Plus, the radial thickness or width of each slot 248 can be about equal to or slightly larger than (e.g., about 0.007 inches wider than) the width of the rotor bar 244. In some embodiments, the rotor bar width is about one inch or one one-half inches.

Accordingly, a relief portion 272 is positioned at each end of the slots 248. In which case, a central or medial portion 284 of each rotor bar 244 is held relatively securely within that portion 288 of the slot 248 that does not include the relief portions 272. Alternatively, other embodiments do not include relief portions and/or include relief portions that extend the entire axial length of the slot.

Various embodiments of the present disclosure provide rotors that are suited for (but not limited to) operation at cryogenic temperatures. Aspects of the present disclosure also include cryogenic pumping systems, electric machines, electric motors, and electric generators that include such rotors. Further aspects of the present disclosure include methods of making and using the foregoing. For example, other aspects of the present disclosure include using a cryogenic pumping system to pump liquefied natural gas, liquefied nitrogen (LN2), liquid oxygen (LO2), among other fluids.

The teachings of the present disclosure can be applied in a wide range of electric machines including electric motors and electric generators. Accordingly, the specific references to cryogenic pumping systems and cryogenic fluids herein should not be construed as limiting the scope of the present disclosure to any specific form/type of cryogenic application. Further, aspects of the present disclosure should also not be limited to use with only cryogenic applications.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A rotor comprising a plurality of laminations having a plurality of slots extending through the laminations, and at least one endring in contact with the laminations and defining a plurality of openings, each said opening being aligned with a different one of said slots, a plurality of rotor bars each positioned within a different one of said slots, each said rotor bar including an end portion received within a different one of said openings, and each said slot including a relief portion only on an interior side of said slot for allowing the rotor bar within said slot to freely deflect generally radially inward into said relief portion.

2. The rotor of claim 1 wherein the endring is mechanically attached to the rotor without fasteners.

3. The rotor of claim 1 wherein the end portion of each said rotor bar is welded to the endring, and wherein each weld between the endring and the end portion of each rotor bar is a spaced distance from the laminations.

4. The rotor of claim 3 wherein each said opening extends through the endring from a first side of the endring to a second side of the endring, and wherein each said weld is on the first side of the endring opposite the laminations.

5. The rotor of claim 4 wherein the endring is not welded to the laminations.

6. An electric machine comprising the rotor of claim 5.

7. A cryogenic pumping system comprising a pump and the electric machine of claim 6 for driving the pump.

8. The rotor of claim 3 wherein each weld between the endring and the end portion of each rotor bar is formed entirely from an aluminum alloy.

9. The rotor of claim 8 wherein the endring and the rotor bars are constructed of the same aluminum alloy.

10. An electric machine comprising the rotor of claim 9.

11. A cryogenic pumping system comprising the pump and the electric machine of claim 10 for driving the pump.

12. The rotor of claim 1 wherein the endring and the rotor bars are constructed of the same aluminum alloy.

13. An electric machine comprising the rotor of claim 12.

14. A cryogenic pumping system comprising the pump and the electric machine of claim 13 for driving the pump.

15. The rotor of claim 1 wherein the endring is substantially solid.

16. The rotor of claim 1 wherein the endring is a machined endring.

17. An electric machine comprising the rotor of claim 1.

18. A cryogenic pumping system comprising a pump and the electric machine of claim 17 for driving the pump.

19. The rotor of claim 1, wherein the plurality of openings extend from a first side of the endring to a second side of the endring, and each said rotor bar extends from the first side of the endring to the second side of the endring.

20. The rotor of claim 19 wherein the endring and the rotor bars are formed entirely from an aluminum alloy.

21. An electric machine comprising the rotor of claim 19.

22. A cryogenic pumping system comprising a pump and the electric machine of claim 21 for driving the pump.

* * * * *

UNITED STATES PATENT AND TRADEMARK OFFICE

CERTIFICATE OF CORRECTION

PATENT NO. : 7,701,105 B2
APPLICATION NO. : 12/390968
DATED : April 20, 2010
INVENTOR(S) : Michael R. Bailey It is certified that error appears in the above-identified patent and that said Letters Patent is hereby corrected as shown below:

In the claims:

At column 6, in claim 11, line 26, replace "the pump" with "a pump".

At column 6, in claim 14, line 31, replace "the pump" with "a pump".

Signed and Sealed this

Eighth Day of June, 2010

David J. Kappos

David J. Kappos
*Director of the United States Patent and Trademark Office*